US009364113B2

(12) United States Patent
Gary et al.

(10) Patent No.: US 9,364,113 B2
(45) Date of Patent: Jun. 14, 2016

(54) LIGHTED INFLATABLE DISPLAY

(71) Applicant: Commercial Christmas Clip Company LLC, Lubbock, TX (US)

(72) Inventors: Lonnie F. Gary, Lubbock, TX (US); Stephen L. Fillipp, Lubbock, TX (US)

(73) Assignee: Commercial Christmas Clip Company LLC, Lubbock, TX (US)

( * ) Notice: Subject to any disclaimer, the term of this patent is extended or adjusted under 35 U.S.C. 154(b) by 0 days.

(21) Appl. No.: 14/685,310

(22) Filed: Apr. 13, 2015

(65) Prior Publication Data

US 2015/0292728 A1 Oct. 15, 2015

Related U.S. Application Data

(60) Provisional application No. 61/978,465, filed on Apr. 11, 2014.

(51) Int. Cl.

| | |
|---|---|
| ***A47G 33/06*** | (2006.01) |
| *F21Y 101/02* | (2006.01) |
| *F21W 121/04* | (2006.01) |

(52) U.S. Cl.

CPC ..... *A47G 33/06* (2013.01); *F21W 2121/04* (2013.01); *F21Y 2101/02* (2013.01)

(58) Field of Classification Search

CPC . A46G 33/06; F21W 2121/04; F21Y 2101/02
USPC ..... 362/123, 808; 446/220, 221, 226
See application file for complete search history.

(56) References Cited

U.S. PATENT DOCUMENTS

| | | | | |
|---|---|---|---|---|
| 4,179,832 | A * | 12/1979 | Lemelson | F21S 2/00 345/32 |
| 6,276,815 | B1 * | 8/2001 | Wu | A63B 43/06 362/234 |
| 6,322,230 | B1 * | 11/2001 | Medici | F21S 9/022 340/321 |
| 6,626,559 | B1 * | 9/2003 | Lin | F21V 3/023 362/123 |
| 6,764,201 | B2 | 7/2004 | Chi-Cheng | |
| 7,198,538 | B2 | 4/2007 | Chin-Cheng | |
| 7,216,446 | B2 | 5/2007 | Machala | |
| 7,235,930 | B1 | 6/2007 | Hsu | |
| 7,302,769 | B2 | 12/2007 | Machala | |
| 7,302,771 | B2 | 12/2007 | Hsu | |
| 7,322,137 | B2 | 1/2008 | Machala | |
| 7,614,171 | B2 | 11/2009 | Hsu | |
| 2006/0164856 | A1 * | 7/2006 | Wang | A63H 3/006 362/554 |
| 2012/0190269 | A1 | 7/2012 | Duncan | |

* cited by examiner

*Primary Examiner* — Laura Tso

(74) *Attorney, Agent, or Firm* — Ross Barnes LLP; Monty L. Ross; Robin L. Barnes

(57) ABSTRACT

A lighted inflatable display including a body made of flexible fabric that is semipermeable to the passage of air through the fabric, at least one divider panel that partitions an interior space within the body into a plurality of chambers, a pressurized air source configured to discharge pressurized air into the body, and a plurality of cooperatively controlled decorative lights disposed inside each chamber, wherein the at least one divider panel reduces light transmission between chambers and includes an aperture permitting passage of pressurized air and an electrical power cord sequentially from a base portion of the inflatable display to each of the chambers.

18 Claims, 2 Drawing Sheets

LIGHTED INFLATABLE DISPLAY

CROSS-REFERENCE TO RELATED APPLICATION

This application claims the benefit of U.S. Application No. 61/978,465, filed Apr. 11, 2014.

BACKGROUND OF THE INVENTION

1. Field of the Invention

This invention relates to lighted displays that are inflatable, preferably by using a continuous source of pressurized air to inflate a display body made of flexible, semipermeable fabric. The display body can be variously shaped, with one preferred shape that is presented as an example taking the stylized form of a Christmas tree. The display body desirably comprises a plurality of spaced-apart, flexible divider panels that partition the display body into a plurality of chambers. Each divider panel is desirably substantially opaque but comprises an opening configured to allow the passage of wiring and air through the divider panels to permit lighting and inflation of the whole display. The lighting desirably comprises independently controllable RBG decorative lights. A sound source and speaker controllable together with or independently of the lights are optionally provided.

2. Description of Related Art

Lighted inflatable displays are previously disclosed, for example, in the following U.S. Pat. Nos. 6,764,201; 7,198,538; 7,216,446; 7,302,769; 7,302,771; 7,322,137; 7,730,769; and 7,614,171.

SUMMARY OF THE INVENTION

An inflatable lighted display is disclosed, the display having a fabric body that assumes a defined shape and defines an interior space when inflated, the body further comprising at least one divider panel that partitions the interior space of the lighted display into a plurality of chambers, an aperture permitting passage of pressurized air and a power cord from a base portion to each of the other chambers, and a plurality of cooperatively controlled decorative lights disposed in each chamber.

The inflatable lighted display disclosed here is satisfactorily made of a flexible translucent fabric, such as nylon, that is semipermeable to the passage of air through the fabric. This allows a fan unit supplying a relatively small volume of pressurized air to the display to maintain the display in a desired shape or configuration without a supporting framework. The fan can desirably run continuously without overheating and also maintain the display in its desired configuration without collapse. Fabric that is either white or some other pale, neutral shade is preferred for good color rendition through the fabric. The subject display can satisfactorily comprise a base portion and a plurality of discrete chambers, segments or layers separated by divider panels so that each chamber has its own nominal air volume when fully inflated. The chambers are satisfactorily separated from the base and from each other by one of a plurality of fabric divider panel that is substantially opaque to isolate light of a desired color within a particular chamber. This provides a more pronounced sequencing of changes in the light colors when the display is viewed from outside.

Each barrier preferably further comprises at least one opening that allows air to flow between the base and adjacent chambers to inflate the whole display body. If desired, check valves can be provided in the openings of the barriers to further control the air flow between adjacent chambers when the fan unit is operating. The openings also facilitate the passage of control wiring from one chamber to the other to supply electricity to the lights disposed in each chamber of the display. According to one embodiment of the invention, the lights are LED bulbs configured in a ring disposed around the air openings of each, although other lighting configurations can also be used within the scope of the present invention.

BRIEF DESCRIPTION OF THE DRAWINGS

The apparatus of the invention is further described and explained in relation to the following drawings wherein.

DESCRIPTION OF ILLUSTRATIVE EMBODIMENT

Figure 1:
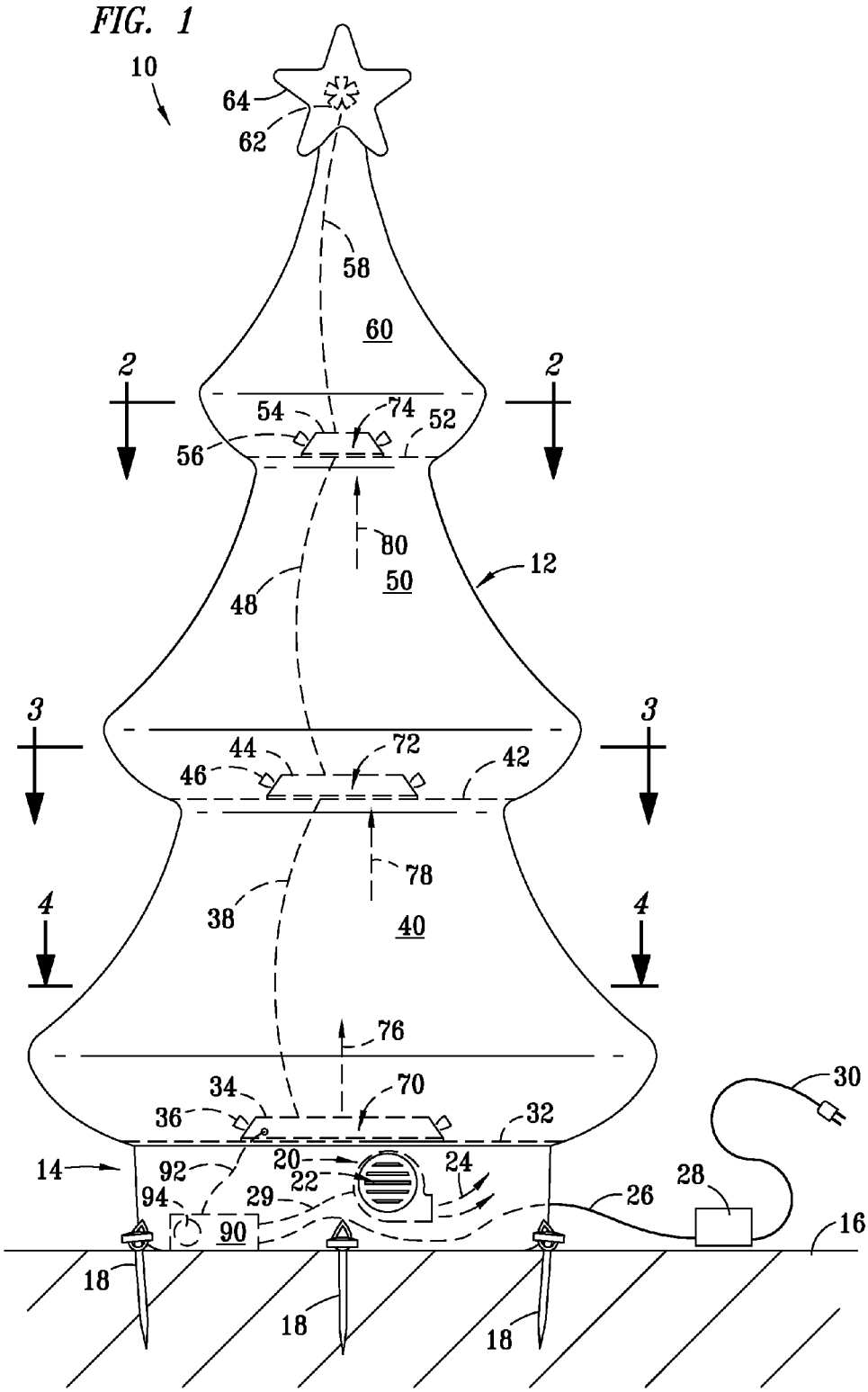
FIG. 1 is a front elevation view of a lighted display that is illustrative of an embodiment of the invention wherein the lighted display has a tiered configuration in the general shape of a Christmas tree.
Figure 2:
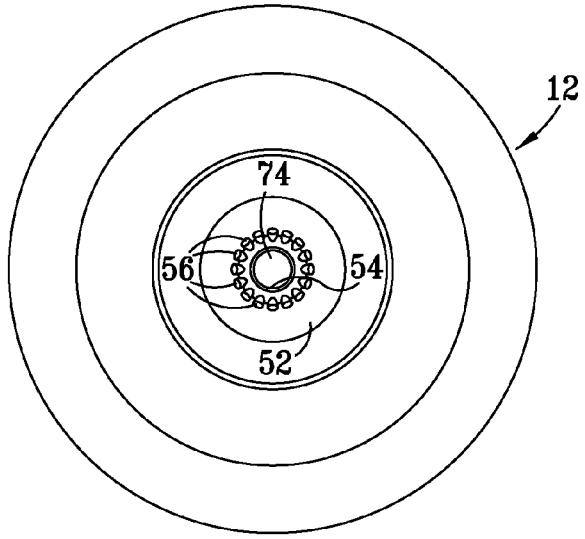
FIG. 2 is a downwardly facing, transverse cross-sectional view of the lighted display of FIG. 1 as taken along line 2-2 of FIG. 1.
Figure 3:
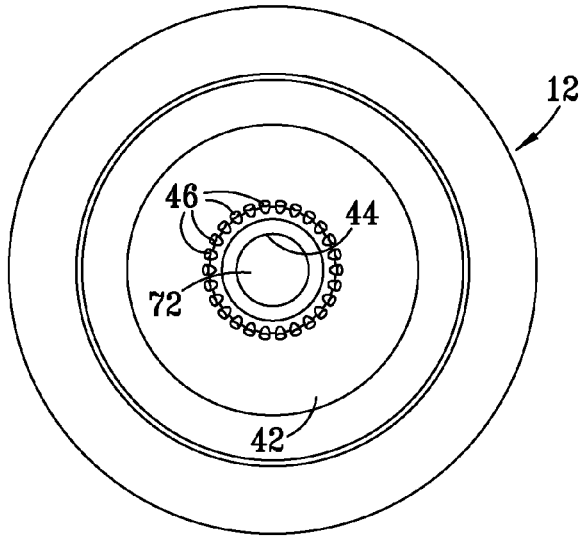
FIG. 3 is a downwardly facing, transverse cross-sectional view of the lighted display of FIG. 1 as taken along line 3-3 of FIG. 1.
Figure 4:
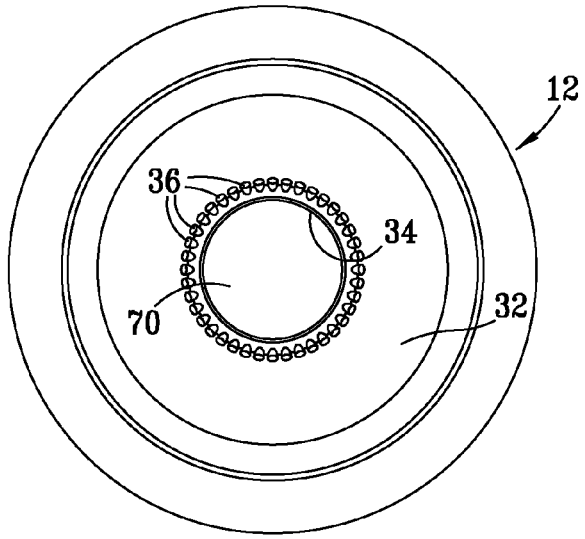
FIG. 4 is a downwardly facing, transverse cross-sectional view of the lighted display of FIG. 1 as taken along line 4-4 of FIG. 1.

Referring to FIG. 1, lighted inflatable display 10 comprises body 12, base portion 14 and a plurality of divider panels 32, 42, 52 that cooperate with body 12 and base portion 14 to form a plurality of tiered chambers 40, 50 and 60 above base 14. Body 12 is satisfactorily made of a durable translucent material such as nylon and is semi-permeable to the passage of pressurized air through its walls. The fabric used for body 12 is desirably light in color, such as white, off-white or light beige, for example, so that light emitted by light bulbs disposed inside chambers 40, 50, 60 will be readily visible through the side wall or walls of body 12. As shown in FIGS. 1-4, lighted inflatable display 10 is configured as a Christmas tree, although it will be appreciated that other shapes and configurations can be easily substituted as desired.

Divider panels 32, 42, 52 can be made of the same or a similar material as body 12, but are desirably coated or otherwise configured to be substantially opaque so that very little if any light is transmitted through the divider panels and substantial light is The perimeters of divider panels 32, 42, 52 are desirably secured to the inside of body 12 by any satisfactory means such as, for example, gluing, stitching, heat welding or through the use of other attachment devices that are well known for use in attaching such materials. In the embodiment shown, divider panels 32, 42, 52 each comprises a centrally disposed opening or aperture 70, 72, 74, respectively, that permit air to flow upwardly through body 12 as indicated by arrows 76, 78, 80, respectively. The flow of air is desirably provided by a pressurized air source such as fan unit 20 that is disposed inside base portion 14 and draws ambient air inwardly through filter grid 22 from outside lighted inflatable display 10 and discharges the pressurized air it inside base portion 14 from where it flows upwardly as noted above.

Fan unit 20 is desirably controlled by electronic controller 90 that can be pre-programmed, programmable, or both, as preferred for a particular product and price point. Fan unit 20 as shown is powered by direct current received through line 26 from AID converter 28 that is connectable by plug 30 to any external alternating current power source. Although controller 90 and fan unit 20 are disclosed in this embodiment as being contained inside base portion 14 of lighted inflatable display 10, it will be appreciated upon reading this disclosure that similar embodiments can be made using fans and controllers that are external to the base of the display.

In the embodiment shown, with reference now to FIGS. 1-4, each divider panel 32, 42, 52 is circular, and the centrally disposed aperture 70, 72, 74 through each respective divider panel is surrounded by a ring 34, 44, 54 that supports a plurality of light bulbs that are represented by bulbs 36, 46, 56 disposed at each tiered level. LED bulbs positioned so that they are directly outwardly toward the nearest portion of the wall of body 12 are preferred for use in the invention because of their light weight, long life and directional light, although it will be appreciated upon reading the disclosure that other types of lamps or bulbs can be similarly used. Also, while rings disposed around apertures 70, 72, 74 in divider panels 32, 42, 52 are preferred for use in the invention, other similarly effective ways and devices for supporting the illuminating lamps of the lighted inflatable display 10 can also be used. Dashed lines 92, 38, 48, 58 are simplified for purposes of the drawings but are intended to represent the electrical wires extending upwardly from controller 90 to rings 34, 44, 54 supporting the LED bulbs at each intermediate level to lamp 62 disposed inside star 64 that is shown at the top of lighted inflatable display 10.

Also shown in FIG. 1 is a speaker 94 that is in this embodiment installed inside controller 90, although it will be appreciated that speakers can also be otherwise positioned as needed to deliver sound as desired. Electronic controllers 90 are now readily available commercially that can be used to play digitally stored or downloaded music in such devices. If desired, electronic controller 90 can also be used to coordinate multiple lighting displays with or without accompanying music. In one embodiment of the invention, lights 36, 46, 56 preferably comprise a string of addressable RGB LED lights. Because the lamps of the light string are individually addressable, the tree can be illuminated in about any way imaginable, creating sequenced bands of color, or revolving patterns of light. This can be synchronized to music to great effect. Because the lights are RGB type, any color desired can be created, which allows great flexibility in seasonal applications.

Stakes 18 passing through fabric loops secured to base portion 14 and inserted downwardly into ground 16 are depicted to be representative of these or other similarly effective tie-down devices that can be used to anchor lighted inflatable display 10 for outdoor use. For some displays having this or other configurations, it may also be desirable to provide other external support lines secured to various portions of the displays to secure them as needed in the use environment.

The main body of the tree can sit on the ground or other underlying support surface, and if used outdoors is preferably staked down for stability, or can be otherwise supported. Some body or figure styles may need guy wires or cords to stabilize the upper parts, especially if used outdoors in the presence of wind.

The main body of the tree is desirably configured to receive pressurized air from an external fan unit or other source that is disposed apart from the body, with a flexible duct or other similarly effective flow path being provided to direct pressurized air into the interior space or volume of the body. If provided, a suitable pressurized air duct can be made from the same fabric as the figure, or from some other impermeable or semi-permeable conduit such as dryer hose. Where used, the duct can connect to the figure by means of a receptacle or similar appliance that uses a friction-fit. It could also have, for example, a twist-lock fastener to make it more secure. The purpose is to make the unit detachable by the user.

A fan and control unit is desired that can produce a high volume of pressurized air to keep the main body inflated despite air leakage through a semi-permeable fabric and other leaks in the device. A satisfactory type of fan is a squirrel cage blower. The control system will also desirably include a system for selectively reproducing sound, including a weather-resistant speaker, and a control system/user interface for providing power to, and selectively controlling, the lights. The sounds and light controls can be configured to operate cooperatively or independently. The control cable for the lights can pass through the duct into interior space in the body of the tree. where a connector will allow the user to disconnect the unit for storage or possibly to connect the unit to a different figure for various seasons. Although not shown in the drawing, the squirrel cage can be oriented against the wall of the cabinet in such a way that air is drawn directly into the intake of the blower rather than through the housing, which would improve the airflow and possibly cut down on noise as well.

Although not depicted in the drawing figure, the bottom panel of the tree can have a sleeve attached to its perimeter with a drawstring inside that will allow the user to fold the upper parts into the middle of the bottom panel along with the fan unit, tighten the drawstring, and have a bagged item for storage.

Other alterations and modifications of the invention will likewise become apparent to those of ordinary skill in the art upon reading this specification in view of the accompanying drawings, and it is intended that the scope of the invention disclosed herein be limited only by the broadest interpretation of the appended claims to which the inventor(s) and/or Applicant are legally entitled.

What is claimed is:

1. A lighted inflatable display comprising a body made of flexible fabric that is semipermeable to the passage of air through the fabric, at least one divider panel that partitions an interior space within the body into a plurality of chambers, a pressurized air source configured to discharge pressurized air into the body, and a plurality of cooperatively controlled decorative lights disposed inside each chamber, wherein the at least one divider panel reduces light transmission between chambers and includes an aperture permitting passage of pressurized air and an electrical power cord sequentially from a base portion of the inflatable display to each of the chambers.

2. The lighted inflatable display of claim 1 wherein the body is made of translucent nylon.

3. The lighted inflatable display of claim 1 wherein the at least one divider panel is a fabric panel that reduces light transmission between chambers.

4. The lighted inflatable display of claim 1 wherein the body is configured in the shape of a Christmas tree.

5. The lighted inflatable display of claim 1 wherein the at least one divider panel is configured as an annular disc having a centrally disposed aperture.

6. The lighted inflatable display of claim 1, further comprising a plurality of RBG lights that are configured to be independently controllable in different chambers.

7. The lighted inflatable display of claim 1, further comprising a plurality of RBG lights that are configured to be independently controllable within each chamber.

8. The lighted inflatable display of claim 1 wherein the pressurized air source is a fan unit that draws air into the base portion of the body.

9. The lighted inflatable display of claim 1, further comprising a control unit configured to selectively control a flow of pressurized air into the fabric body.

10. The lighted inflatable display of claim 1, further comprising at least one external power cord and an A/D converter supplying electrical power to the lighted display.

11. The lighted inflatable display of claim 9 wherein the control unit is also configured to selectively control the decorative lights.

12. The lighted inflatable display of claim 11, wherein the control unit is configured to selectively and cooperatively control an illumination sequence and duration of the decorative lights.

13. The lighted inflatable display of claim 1 comprising at least one audio speaker and a control unit configured to selectively control an audio signal that is directed to the speaker.

14. The lighted inflatable display of claim 13 wherein the lights and audio signal are cooperatively controlled.

15. The lighted inflatable display of claim 1 wherein the decorative lights in each chamber are supported inside the chamber by an at least one divider panel defining boundary of the chamber.

16. The lighted inflatable display of claim 1 wherein the fabric body is collapsible inside the base portion.

17. The lighted inflatable display of claim 1 wherein the fabric body is stabilized by at least one external support member.

18. The lighted inflatable display of claim 17 wherein the base portion is stabilized by at least one external support member.

* * * * *